US012397393B2

(12) United States Patent
Bando

(10) Patent No.: US 12,397,393 B2
(45) Date of Patent: Aug. 26, 2025

(54) PROCESSING APPARATUS FOR BRITTLE PLATE AND PROCESSING METHOD FOR BRITTLE PLATE

(71) Applicant: BANDO KIKO Co., Ltd., Tokushima (JP)

(72) Inventor: Kazuaki Bando, Tokushima (JP)

(73) Assignee: Bando Kiko Co., LTD, Tokushima (JP)

( * ) Notice: Subject to any disclaimer, the term of this patent is extended or adjusted under 35 U.S.C. 154(b) by 0 days.

(21) Appl. No.: 17/619,287

(22) PCT Filed: Jul. 15, 2021

(86) PCT No.: PCT/JP2021/026550
§ 371 (c)(1),
(2) Date: Dec. 15, 2021

(87) PCT Pub. No.: WO2022/195907
PCT Pub. Date: Sep. 22, 2022

(65) Prior Publication Data

US 2023/0146769 A1 May 11, 2023

(30) Foreign Application Priority Data

Mar. 18, 2021 (JP) ..... 2021-045291

(51) Int. Cl.
*B24B 9/10* (2006.01)
*B24B 49/00* (2012.01)
*B24B 49/12* (2006.01)

(52) U.S. Cl.
CPC ..... *B24B 49/12* (2013.01); *B24B 9/10* (2013.01); *B24B 49/00* (2013.01)

(58) Field of Classification Search
CPC ..... B24B 49/12; B24B 49/10; B24B 49/00; B24B 49/02; B24B 49/04; B24B 49/08;
(Continued)

(56) References Cited

U.S. PATENT DOCUMENTS 1,723,529 A * 8/1929 Schwieterman ..... B23Q 15/22 33/642

FOREIGN PATENT DOCUMENTS

JP 11-300612 11/1999
JP H11300612 A * 11/1999
(Continued)

*Primary Examiner* — David S Posigian
*Assistant Examiner* — Michael A Gump
(74) *Attorney, Agent, or Firm* — Millen, White, Zelano & Branigan, P.C.; Christopher W. Brody

(57) ABSTRACT

A processing apparatus for brittle plate includes a table which holds a brittle plate, a processing head having a processing wheel for processing an outer peripheral edge of the brittle plate held by the table, a measuring portion which measures a positional shift amount Δ in an axis direction of the processing wheel with respect to the brittle plate, and a control portion which corrects a positional shift in a Z-axis direction of the processing wheel on the basis of a positional shift amount Δ in the axis direction of the processing wheel measured by the measuring portion and causes the processing wheel whose positional shift was corrected to process the outer peripheral edge of the brittle plate. The processing apparatus and its method can reduce time and labor of manually positioning of a processing wheel to the brittle plate after processing wheel replacement.

5 Claims, 10 Drawing Sheets

(58) Field of Classification Search
CPC ..... B24B 49/16; B24B 49/105; B24B 9/10; B24B 9/00; B24B 9/065; B24B 9/08; B24B 9/002; B24B 9/005; B24B 9/06; B24B 9/102; B24B 9/107; B24B 41/02; B24B 47/22; H01L 21/68; H01L 2223/54426; B23Q 3/18; B23Q 3/186; B23Q 17/2233; B23Q 15/22; B25J 9/1692
USPC ..... 451/5
See application file for complete search history.

(56) References Cited

FOREIGN PATENT DOCUMENTS

| | | | |
|---|---|---|---|
| JP | 2010-058265 | | 3/2010 |
| KR | 20120013929 A | * | 2/2012 |
| WO | 2018/132661 | | 7/2018 |

* cited by examiner

PROCESSING APPARATUS FOR BRITTLE PLATE AND PROCESSING METHOD FOR BRITTLE PLATE

TECHNICAL FIELD

The present invention relates to a processing apparatus for brittle plate, which grinds or polishes or grinds and polishes (hereinafter, referred to as processing) an outer peripheral edge of a rectangular brittle plate, for example, in the brittle plate for automobiles, for liquid crystal panels such as liquid crystal TV sets, for solar batteries, for furniture, for construction and the like and a processing method for brittle plate.

BACKGROUND ART

Conventionally, in a grinding device for a glass plate, for example, a grinding wheel is rotated by an operation of an electric motor and is brought into contact with a peripheral edge of the glass plate so as to grind the glass plate, for example.

CITATION LIST

Patent Literature

[Patent Literature 1] Japanese Patent Application Publication No. 2010-58265

SUMMARY OF INVENTION

Technical Problem

With the grinding device for a glass plate disclosed in the aforementioned Patent Literature 1, as a method for aligning a glass grinding position with a grinding wheel position at replacement of the grinding wheel or the like, a dimension from a grinding-wheel mounting surface to a reference position of grinding wheel groove is manually aligned in the grind wheel production, but with this method, a processed shape can be slightly shifted when the glass plate is processed. Thus, such a method is employed that the grinding wheel position is re-adjusted by checking the processed shape of the glass plate at first processing, which takes time to position the grinding wheel to the glass plate and lowers efficiency of the processing of the glass plate as a whole.

The present invention was made in view of the aforementioned problems and has an object to provide a processing apparatus for brittle plate and a processing method for brittle plate, which can reduce time and labor of manual positioning of a processing wheel with respect to the brittle plate after the replacement of the processing wheel and has high efficiency in processing of the brittle plate as a whole by automatically measuring a positional shift amount of the processing wheel before processing of the brittle plate without testing the positioning between the brittle plate and the processing wheel groove by a manual work several times, and by automatically correcting the positional shift of the processing wheel on the basis of the positional shift amount so as to cause the processing wheel whose positional shift was corrected to process the outer peripheral edge of the brittle plate.

Another object of the present invention is to provide a processing apparatus for brittle plate and a processing method for brittle plate, which can reduce time and labor of manual positioning of the processing wheel with respect to the brittle plate after the replacement of the processing wheel and has high efficiency in processing of the brittle plate as a whole by automatically measuring the positional shift amount of the processing wheel before the processing of the brittle plate, by automatically correcting the positional shift of the processing wheel on the basis of the positional shift amount, by alternately repeating the measurement and correction, and by automatically correcting the positional shift of the processing wheel with more accuracy so as to cause the processing wheel whose positional shift was corrected to process the outer peripheral edge of the brittle plate.

Solution to Problem

A first feature of the present invention in order to solve the aforementioned problem is characterized by that a processing apparatus for brittle plate includes a table which holds the brittle plate, a processing head having a processing wheel for processing an outer peripheral edge of the brittle plate held by the table, a measuring portion which measures a positional shift amount in an axis direction of the processing wheel with respect to the brittle plate, and a control portion which corrects a positional shift in the axis direction of the processing wheel on the basis of the positional shift amount in the axis direction of the processing wheel measured by the measuring portion and causes the processing wheel whose positional shift was corrected to process the outer peripheral edge of the brittle plate.

As an example of the processing apparatus for brittle plate of the present invention having the first feature, the measuring portion includes a mounting plate, a moving base provided capable of relative movement with respect to the mounting plate in a first direction orthogonal to an axis of the processing wheel, moving means for moving the moving base in the first direction, and rotating means provided on the moving base and having a shaft member including a distal end portion, in which the measuring portion causes the shaft member to be rotated in a first rotating direction around a shaft thereof and causes the distal end portion to be brought into contact with the processing surface of the processing wheel, measures a first position where the distal end portion is rotated in the first rotating direction and is brought into contact with the processing surface of the processing wheel, causes the shaft member to be rotated in a second rotating direction which is a direction opposite to the first rotating direction and causes the distal end portion to be brought into contact with the processing surface of the processing wheel, and measures a second position where the distal end portion is rotated in the second rotating direction and is brought into contact with the processing surface of the processing wheel, and the control portion calculates a first distance from a predetermined processing reference position to the first position in the axis direction of the processing wheel, calculates a second distance from the predetermined processing reference position to the second position in the axis direction of the processing wheel, calculates a positional shift amount in the axis direction of the processing wheel on the basis of the first distance and the second distance, corrects the positional shift in the axis direction of the processing wheel on the basis of the positional shift amount in the axis direction of the processing wheel, and causes the processing wheel whose positional shift was corrected to process an outer peripheral edge of the brittle plate.

As another example of the processing apparatus for brittle plate of the present invention having the first feature, the processing apparatus for brittle plate alternately repeats measurement of a first position and a second position by the measuring portion and correction of a positional shift in the axis direction of the processing wheel by the control portion several times and causes the processing wheel whose positional shift was corrected several times to process the outer peripheral edge of the brittle plate.

Another example of the processing apparatus for brittle plate of the present invention having the first feature is that the rotating means is a servomotor which controls a torque.

As another example of the processing apparatus for brittle plate of the present invention having the first feature, the measuring portion includes a mounting plate, a moving base provided capable of relative movement with respect to the mounting plate in a first direction orthogonal to the axis of the processing wheel, moving means for moving the moving base in the first direction, and laser measuring means provided on the moving base and measuring a processing surface by emitting a laser to the processing surface of the processing wheel, in which the control portion calculates a positional shift amount in the axis direction of the processing wheel from a predetermined processing reference position on the basis of a measured value measured by the laser measuring means, corrects the positional shift in the axis direction of the processing wheel on the basis of the positional shift amount from the predetermined processing reference position in the axis direction of the processing wheel, and causes the processing wheel whose positional shift was corrected to process the outer peripheral edge of the brittle plate.

As another example of the processing apparatus for brittle plate of the present invention having the first feature, in a state where a laser is emitted to the processing surface of the processing wheel, the laser measuring means measures the processing surface of the processing wheel by movement of at least either one of the processing wheel and the laser measuring means from one to the other in the axis direction of the processing wheel, and the control portion calculates a positional shift amount in the axis direction of the processing wheel on the basis of a position where a distance from the laser measuring means to the processing surface of the processing wheel in the first direction measured by the laser measuring means becomes the maximum and the predetermined processing reference position, corrects the positional shift in the axis direction of the processing wheel on the basis of the positional shift amount in the axis direction of the processing wheel, and causes the processing wheel whose positional shift was corrected to process the outer peripheral edge of the brittle plate.

As another example of the processing apparatus for brittle plate of the present invention having the first feature, the laser measuring means measures the processing surface of the processing wheel by emitting a laser to a predetermined region or the entire region on the processing surface in the axis direction of the processing wheel and, and the control portion calculates a positional shift amount in the axis direction of the processing wheel on the basis of a position where a distance from the laser measuring means to the processing surface of the processing wheel in the first direction measured by the laser measuring means becomes the maximum and the predetermined processing reference position, corrects the positional shift in the axis direction of the processing wheel on the basis of the positional shift amount in the axis direction of the processing wheel, and causes the processing wheel whose positional shift was corrected to process the outer peripheral edge of the brittle plate.

A second feature of the present invention for solving the aforementioned problem is a processing method for brittle plate using a processing apparatus for brittle plate, including a table which holds the brittle plate, a processing head having a processing wheel for processing an outer peripheral edge of the brittle plate held by the table, a measuring portion which measures a positional shift amount in an axis direction of the processing wheel with respect to the brittle plate, and a control portion which corrects a positional shift in the axis direction of the processing wheel on the basis of the positional shift amount in the axis direction of the processing wheel measured by the measuring portion and causes the processing wheel whose positional shift was corrected to process the outer peripheral edge of the brittle plate, the processing method for brittle plate, including a measuring process of measuring a positional shift amount in an axis direction of the processing wheel with respect to the brittle plate, a correcting process of correcting a positional shift in the axis direction of the processing wheel on the basis of the positional shift amount measured in the measuring process, and a processing process of causing the processing wheel whose positional shift was corrected after the correcting process to process an outer peripheral edge of the brittle plate.

A third feature of the present invention for solving the aforementioned problem is a processing method for brittle plate using a processing apparatus for brittle plate, including a table which holds the brittle plate, a processing head having a processing wheel for processing an outer peripheral edge of the brittle plate held by the table, a measuring portion which measures a positional shift amount in an axis direction of the processing wheel with respect to the brittle plate, and a control portion which corrects a positional shift in the axis direction of the processing wheel on the basis of the positional shift amount in the axis direction of the processing wheel measured by the measuring portion and causes the processing wheel whose positional shift was corrected to process the outer peripheral edge of the brittle plate, the measuring portion including a mounting plate, a moving base provided capable of relative movement with respect to the mounting plate in a first direction orthogonal to the axis of the processing wheel, moving means for moving the moving base in the first direction, and rotating means provided on the moving base and having a shaft member including a distal end portion, the processing method for brittle plate, including a positioning process of positioning the shaft member to a predetermined position, a first measuring process of bringing the distal end portion into contact with the processing surface of the processing wheel by rotating the shaft member in a first rotating direction around a shaft thereof and of measuring a first position on the processing surface of the processing wheel with which the distal end portion is brought into contact, a second measuring process of bringing the distal end portion into contact with the processing surface of the processing wheel by rotating the shaft member in a second rotating direction which is a direction opposite to the first rotating direction and of measuring a second position on the processing surface of the processing wheel with which the distal end portion is brought into contact, a calculating process of calculating a first distance in the axis direction of the processing wheel from a predetermined processing reference position to the first position, of calculating a second distance in the axis direction of the processing wheel from the predetermined processing reference position to the second position and of calculating a positional shift amount in the axis direction of the processing wheel on the basis of the first distance and the second distance, a correcting process of correcting the positional shift in the axis direction of the processing wheel on the basis of the positional shift amount in the axis direction of the processing wheel, and a processing process of causing the processing wheel whose positional shift was corrected after the correcting process to process an outer peripheral edge of the brittle plate.

As an example of the processing apparatus for brittle plate of the present invention having the third feature, the processing method for brittle plate repeats the first measuring process, the second measuring process, the calculating process, and the correcting process several times, and the processing wheel whose positional shift was corrected several times is caused to process the outer peripheral edge of the brittle plate.

A fourth feature of the present invention for solving the aforementioned problem is a processing method for brittle plate using a processing apparatus for brittle plate, including a table which holds the brittle plate, a processing head having a processing wheel for processing an outer peripheral edge of the brittle plate held by the table, a measuring portion which measures a positional shift amount in an axis direction of the processing wheel with respect to the brittle plate, and a control portion which corrects a positional shift in the axis direction of the processing wheel on the basis of the positional shift amount in the axis direction of the processing wheel measured by the measuring portion and causes the processing wheel whose positional shift was corrected to process the outer peripheral edge of the brittle plate, the measuring portion including a mounting plate, a moving base provided capable of relative movement with respect to the mounting plate in a first direction orthogonal to the axis of the processing wheel, moving means for moving the moving base in the first direction, and laser measuring means provided on the moving base and measuring a processing surface by emitting a laser to the processing surface of the processing wheel, the processing method for brittle plate, including a positioning process of positioning the laser measuring means to a predetermined position, a measuring process of measuring the processing surface of the processing wheel by emitting the laser beam of the laser measuring means to the processing surface of the processing wheel, a calculating process of calculating a positional shift amount in the axis direction of the processing wheel on the basis of a measured value measured by the laser measuring means, a correcting process of correcting the positional shift in the axis direction of the processing wheel on the basis of the positional shift amount in the axis direction of the processing wheel, and a processing process of causing the processing wheel whose positional shift was corrected after the correcting process to process an outer peripheral edge of the brittle plate.

As an example of the processing apparatus for brittle plate of the present invention having the fourth feature, in the measuring process, in a state where the laser measuring means emits a laser to the processing surface of the processing wheel, the processing surface of the processing wheel is measured by movement of at least either one of the processing wheel and the laser measuring means from one to the other in the axis direction of the processing wheel, and in the calculating process, a positional shift amount in the axis direction of the processing wheel is calculated on the basis of a position where a distance from the laser measuring means to the processing surface of the processing wheel in the first direction measured by the laser measuring means becomes the maximum and a predetermined processing reference position.

As another example of the processing apparatus for brittle plate of the present invention having the fourth feature, in the measuring process, the processing surface of the processing wheel is measured by the laser measuring means by emitting a laser to a predetermined region or the entire region on the processing surface in the axis direction of the processing wheel, and in the calculating process, on the basis of the position where the distance from the laser measuring means to the processing surface of the processing wheel in the first direction measured by the laser measuring means becomes the maximum and the predetermined processing reference position, the positional shift amount in the axis direction of the processing wheel is calculated.

Advantageous Effect of Invention

According to the processing apparatus for brittle plate having the first feature, since the measuring portion measures the positional shift amount in the axis direction of the processing wheel with respect to the brittle plate, and the control portion corrects the positional shift in the axis direction of the processing wheel on the basis of the positional shift amount in the axis direction of the processing wheel measured by the measuring portion and causes the processing wheel whose positional shift was corrected to process the outer peripheral edge of the brittle plate, such a processing apparatus for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to the one processing apparatus for brittle plate having the first feature, since the control portion calculates the first distance from the predetermined processing reference position to the first position in the axis direction of the processing wheel, calculates the second distance from the predetermined processing reference position to the second position in the axis direction of the processing wheel, calculates the positional shift amount in the axis direction of the processing wheel on the basis of the first distance and the second distance, corrects the positional shift in the axis direction of the processing wheel on the basis of the positional shift amount in the axis direction of the processing wheel, and causes the processing wheel whose positional shift was corrected to process the outer peripheral edge of the brittle plate, such a processing apparatus for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to another processing apparatus for brittle plate having the first feature, by alternately repeating the measurement of the first position and the second position by the measuring portion and the correction of the positional shift in the axis direction of the processing wheel by the control portion several times, since the positional shift of the processing wheel is automatically corrected with more accuracy, and the processing wheel whose positional shift was corrected is caused to process the outer peripheral edge of the brittle plate, such a processing apparatus for brittle plate can be provided that, the labor and time for the manual positioning of the processing wheel with respect to the brittle plate after the replacement of the processing wheel can be reduced, and efficiency of the processing of the brittle plate is high as a whole.

According to another processing apparatus for brittle plate having the first feature, since the rotating means is a servomotor which controls a torque, at a position where the distal end portion of the shaft member is in contact with the processing surface, a rotation (angle) of the rotating means can be controlled and reliably stopped and thus, the positional shift amount of the processing wheel can be measured with more accuracy, and the positional shift of the processing wheel can be corrected with accuracy.

According to another processing apparatus for brittle plate having the first feature, since the control portion calculates the positional shift amount from the predetermined processing reference position in the axis direction of the processing wheel on the basis of the measured value measured by the laser measuring means, corrects the positional shift in the axis direction of the processing wheel on the basis of the positional shift amount from the predetermined processing reference position in the axis direction of the processing wheel, and causes the processing wheel whose positional shift was corrected to process the outer peripheral edge of the brittle plate, such a processing apparatus for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to another processing apparatus for brittle plate having the first feature, in the state where the laser measuring means emits a laser to the processing surface of the processing wheel, the laser measuring means measures the processing surface of the processing wheel by movement of at least either one of the processing wheel and the laser measuring means from one to the other in the axis direction of the processing wheel, and the control portion calculates the positional shift amount in the axis direction of the processing wheel on the basis of the position where the distance from the laser measuring means to the processing surface of the processing wheel in the first direction measured by the laser measuring means becomes the maximum and the predetermined processing reference position, corrects the positional shift in the axis direction of the processing wheel on the basis of the positional shift amount in the axis direction of the processing wheel, and causes the processing wheel whose positional shift was corrected to process the outer peripheral edge of the brittle plate and thus, such a processing apparatus for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to another processing apparatus for brittle plate having the first feature, since the laser measuring means measures the processing surface of the processing wheel by emitting a laser to the predetermined region or the entire region on the processing surface in the axis direction of the processing wheel, and the control portion calculates the positional shift amount in the axis direction of the processing wheel on the basis of the position where the distance from the laser measuring means to the processing surface of the processing wheel in the first direction measured by the laser measuring means becomes the maximum and the predetermined processing reference position, corrects the positional shift in the axis direction of the processing wheel on the basis of the positional shift amount in the axis direction of the processing wheel, and causes the processing wheel whose positional shift was corrected to process the outer peripheral edge of the brittle plate, such a processing apparatus for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to the processing method for brittle plate having the second feature, since the processing method for brittle plate includes the measuring process of measuring the positional shift amount in the axis direction of the processing wheel with respect to the brittle plate, the correcting process of correcting the positional shift in the axis direction of the processing wheel on the basis of the positional shift amount measured in the measuring process, and the processing process of causing the processing wheel whose positional shift was corrected after the correcting process to process the outer peripheral edge of the brittle plate, such a processing method for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to the processing method for brittle plate having the third feature, since the processing method for brittle plate includes the positioning process of positioning the shaft member to the predetermined position, the first measuring process of bringing the distal end portion into contact with the processing surface of the processing wheel by rotating the shaft member in the first rotating direction around the shaft thereof and of measuring the first position on the processing surface of the processing wheel with which the distal end portion is brought into contact, the second measuring process of bringing the distal end portion into contact with the processing surface of the processing wheel by rotating the shaft member in the second rotating direction which is the direction opposite to the first rotating direction and of measuring the second position on the processing surface of the processing wheel with which the distal end portion is brought into contact, the calculating process of calculating the first distance in the axis direction of the processing wheel from the predetermined processing reference position to the first position, of calculating the second distance in the axis direction of the processing wheel from the predetermined processing reference position to the second position, and of calculating the positional shift amount in the axis direction of the processing wheel on the basis of the first distance and the second distance, the correcting process of correcting the positional shift in the axis direction of the processing wheel on the basis of the positional shift amount in the axis direction of the processing wheel, and the processing process of causing the processing wheel whose positional shift was corrected after the correcting process to process the outer peripheral edge of the brittle plate, such a processing method for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to the one processing method for brittle plate having the third feature, since the processing method for brittle plate repeats the first measuring process, the second measuring process, the calculating process, and the correcting process several times so that the positional shift of the processing wheel can be automatically corrected with more accuracy, and the processing wheel whose positional shift was corrected several times is caused to process the outer peripheral edge of the brittle plate, such a processing method for brittle plate can be provided that the labor and time for the manual positioning of the processing wheel with respect to the brittle plate after the replacement of the processing wheel can be reduced, and efficiency of the processing of the brittle plate is high as a whole.

According to the processing method for brittle plate having the fourth feature, since the processing method for brittle plate includes the positioning process of positioning the laser measuring means to the predetermined position, the measuring process of measuring the processing surface of the processing wheel by emitting the laser beam of the laser measuring means to the processing surface of the processing wheel, the calculating process of calculating the positional shift amount in the axis direction of the processing wheel on the basis of the measured value measured by the laser measuring means, the correcting process of correcting the positional shift in the axis direction of the processing wheel on the basis of the positional shift amount in the axis direction of the processing wheel, and the processing process of causing the processing wheel whose positional shift was corrected after the correcting process to process the outer peripheral edge of the brittle plate, such a processing method for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to the one processing method for brittle plate having the fourth feature, since in the measuring process, in the state where the laser measuring means emits a laser to the processing surface of the processing wheel, the processing surface of the processing wheel is measured by movement of at least either one of the processing wheel and the laser measuring means from one to the other in the axis direction of the processing wheel, and in the calculating process, the positional shift amount in the axis direction of the processing wheel is calculated on the basis of the position where the distance from the laser measuring means to the processing surface of the processing wheel in the first direction measured by the laser measuring means becomes the maximum and the predetermined processing reference position, such a processing method for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

According to another processing method for brittle plate having the fourth feature, in the measuring process, the processing surface of the processing wheel is measured by the laser measuring means by emitting a laser to the predetermined region or the entire region on the processing surface in the axis direction of the processing wheel, and in the calculating process, on the basis of the position where the distance from the laser measuring means to the processing surface of the processing wheel in the first direction measured by the laser measuring means becomes the maximum and the predetermined processing reference position, the positional shift amount in the axis direction of the processing wheel is calculated, such a processing method for brittle plate can be provided that, without a need to test the positioning by a manual work between the brittle plate and the processing wheel groove several times, the labor and time for the manual positioning of the processing wheel with respect to the brittle plate after the replacement of the processing wheel can be reduced, and efficiency of the processing of the brittle plate is high as a whole.

DESCRIPTION OF EMBODIMENTS

Figure 1:
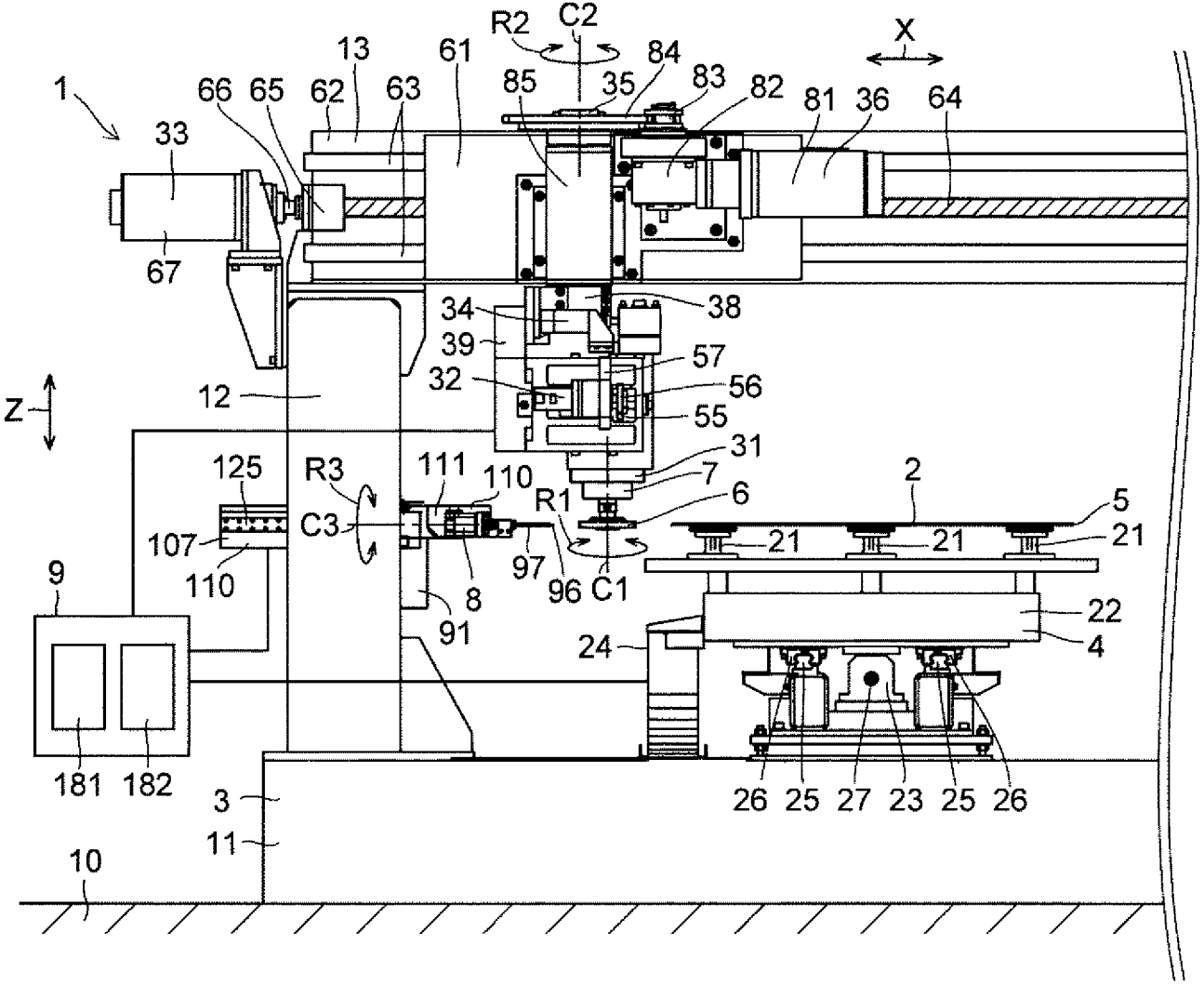
FIG. 1 is a front view of a processing apparatus for brittle plate illustrated as an example.

Hereinafter, embodiments for working the present invention will be described by referring to the drawings. In each figure, the same or corresponding signs are given to the same or corresponding constitutions, and explanation will be omitted. The present invention is not limited to these embodiments at all.

Figure 2:
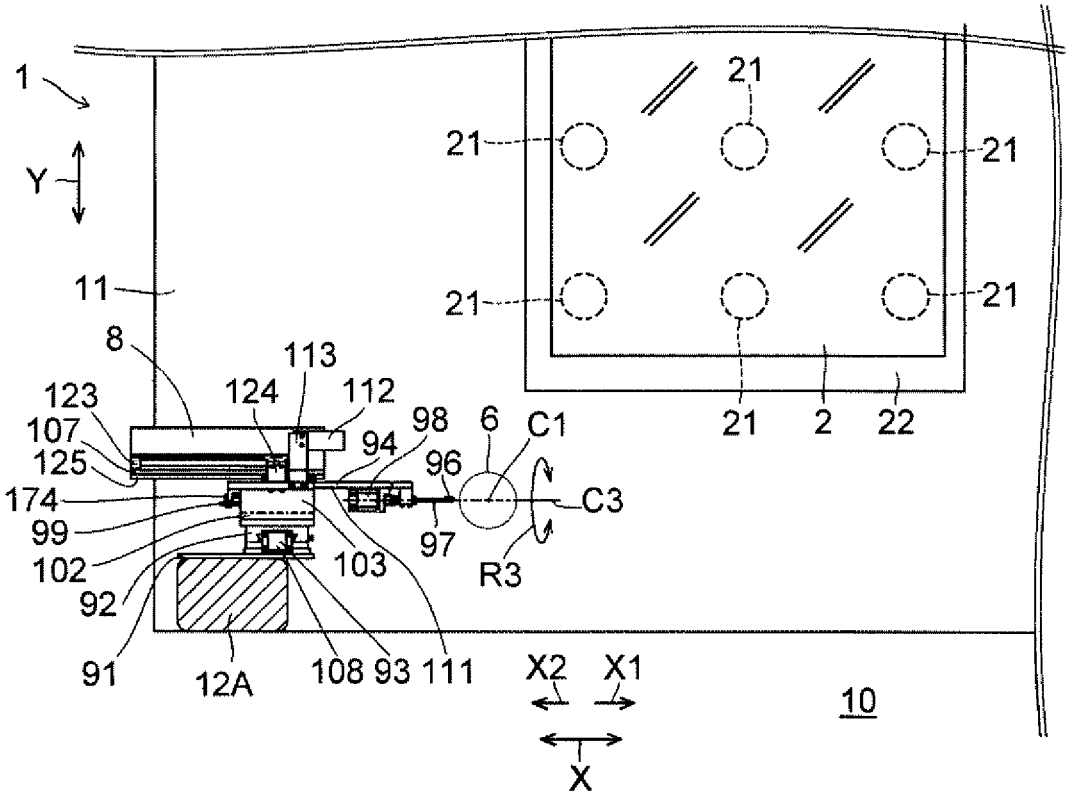
FIG. 2 is a partially-omitted planar explanatory view of the processing apparatus for brittle plate shown in FIG. 1.
Figure 3:
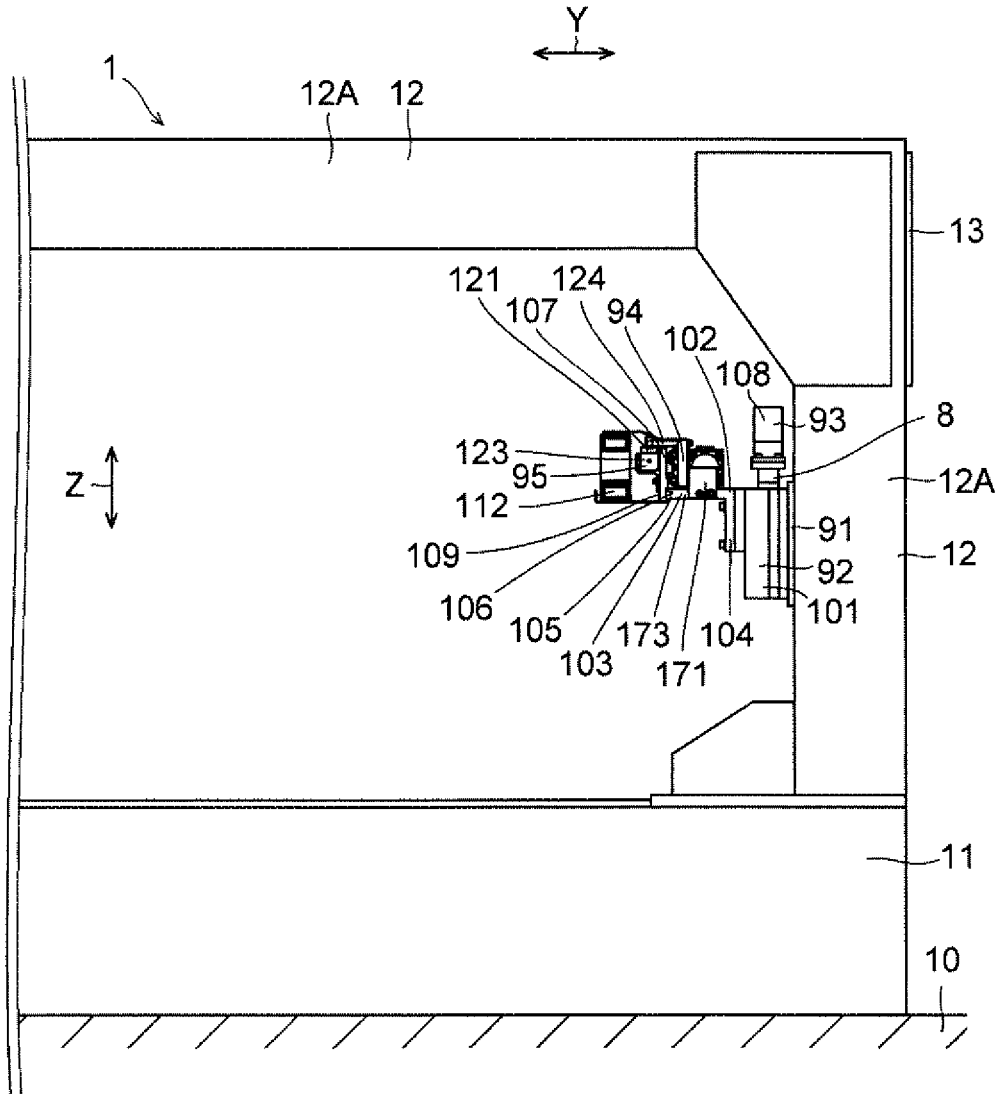
FIG. 3 is a partially-omitted left-side explanatory view of the processing apparatus for brittle plate shown in FIG. 1.
Figure 4A:
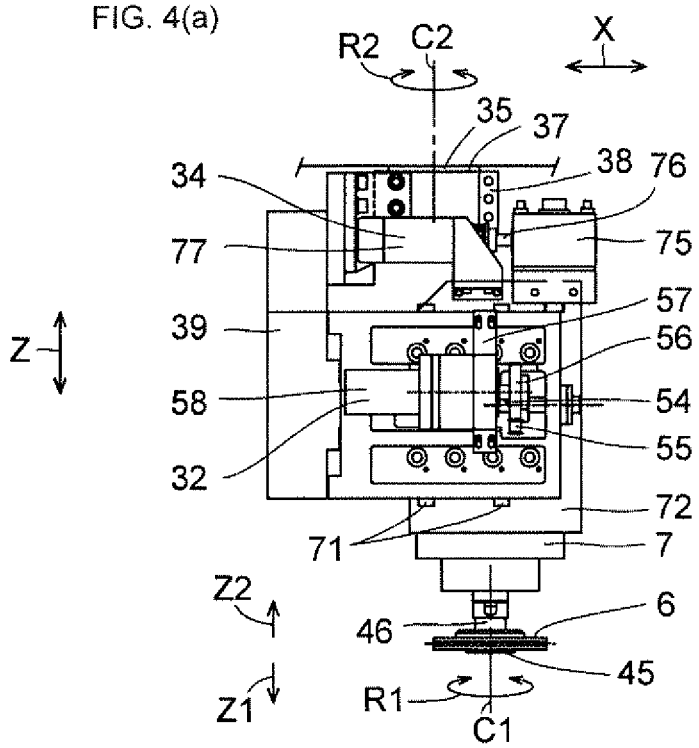
FIG. 4 are explanatory views of a processing head of the processing apparatus for brittle plate shown in FIG. 1.
Figure 4B:
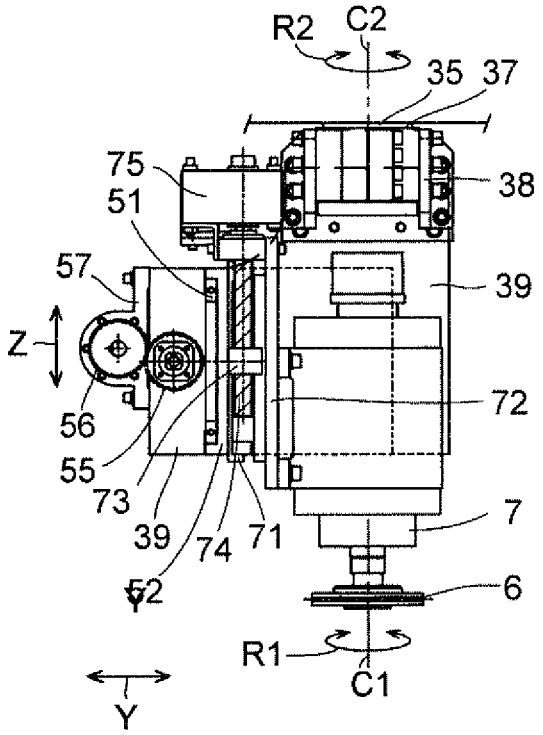
Figure 4C:
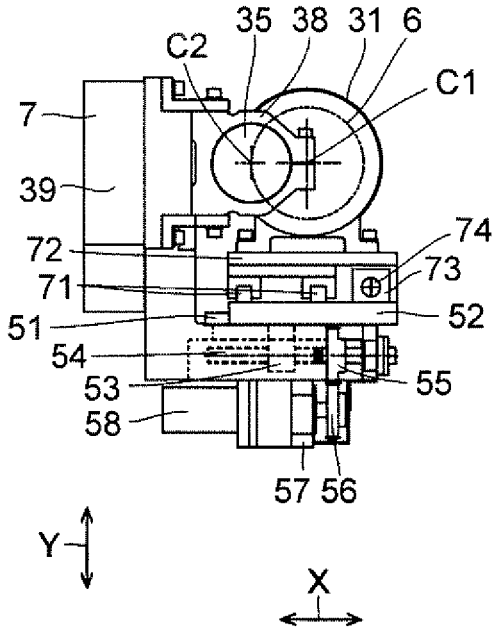
Figure 5:
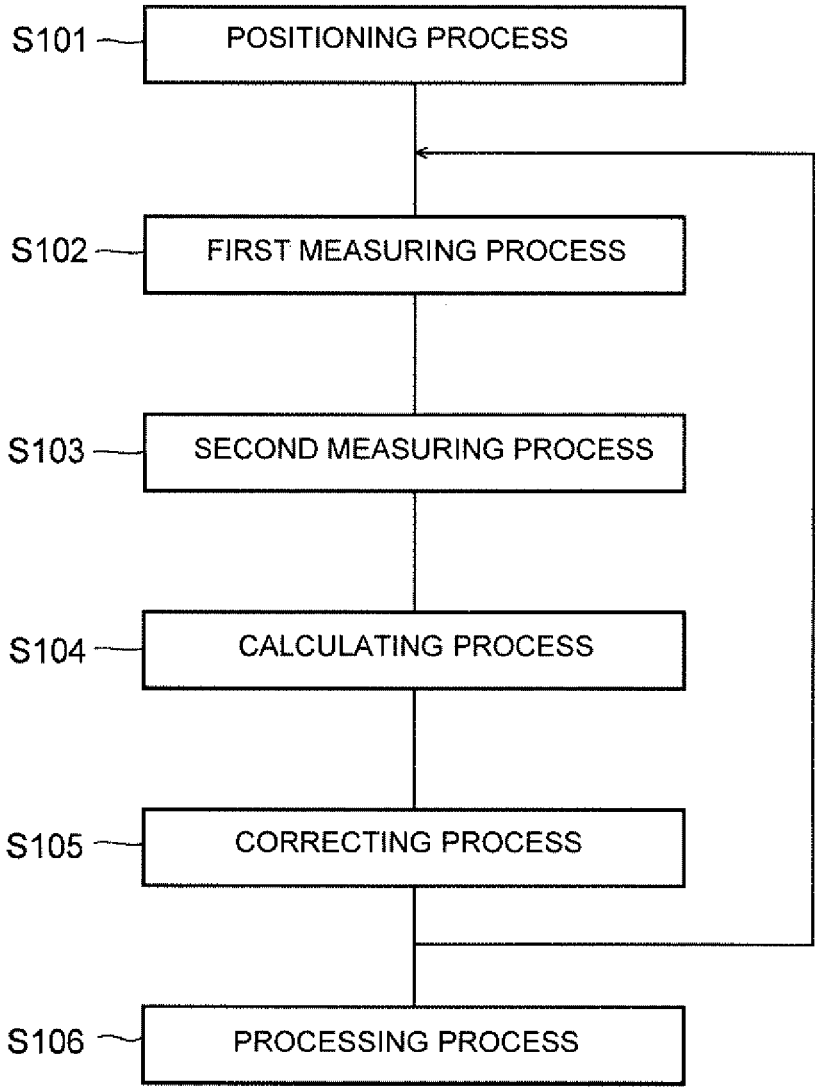
FIG. 5 is a flowchart illustrating a processing method for brittle plate using the processing apparatus for brittle plate shown in FIG. 1.
Figure 6A:
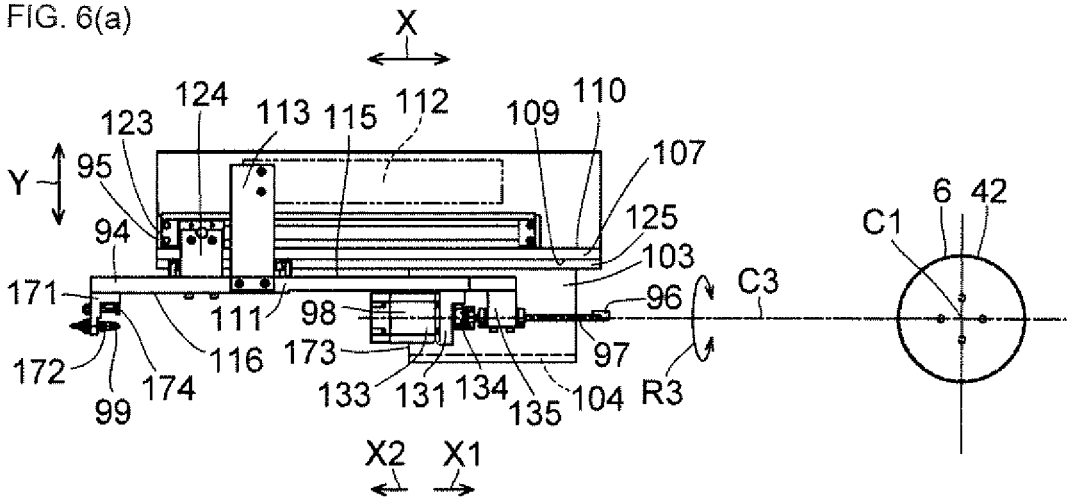
FIG. 6 are explanatory views of an operation of a measuring portion of the processing apparatus for brittle plate shown in FIG. 1.
Figure 6B:
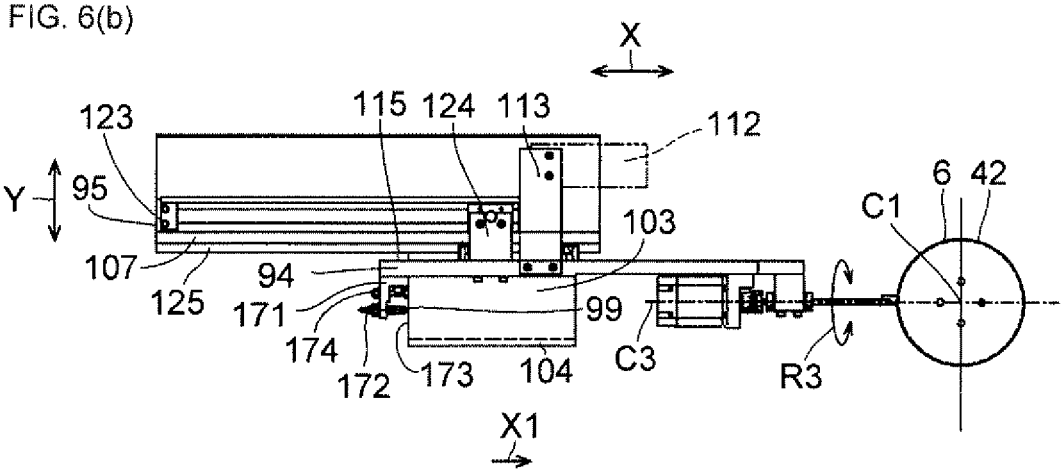
Figure 6C:
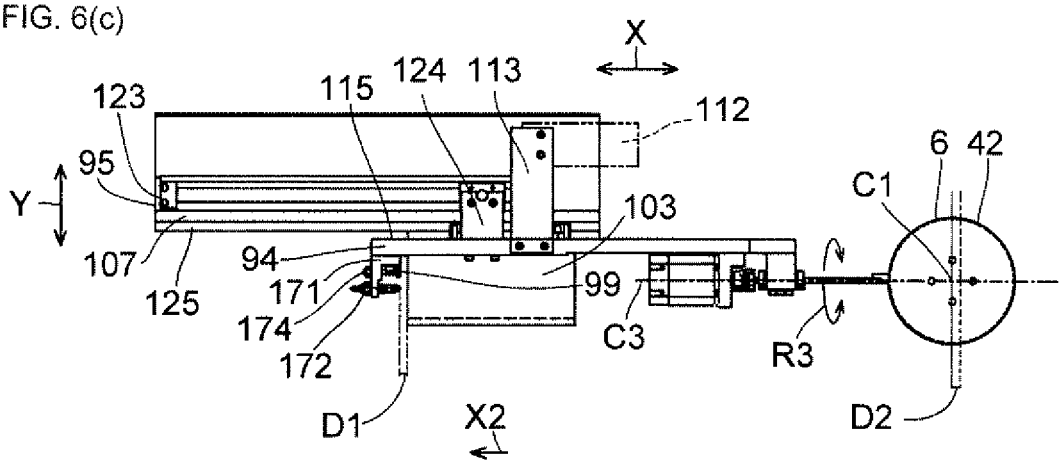
Figure 7A:
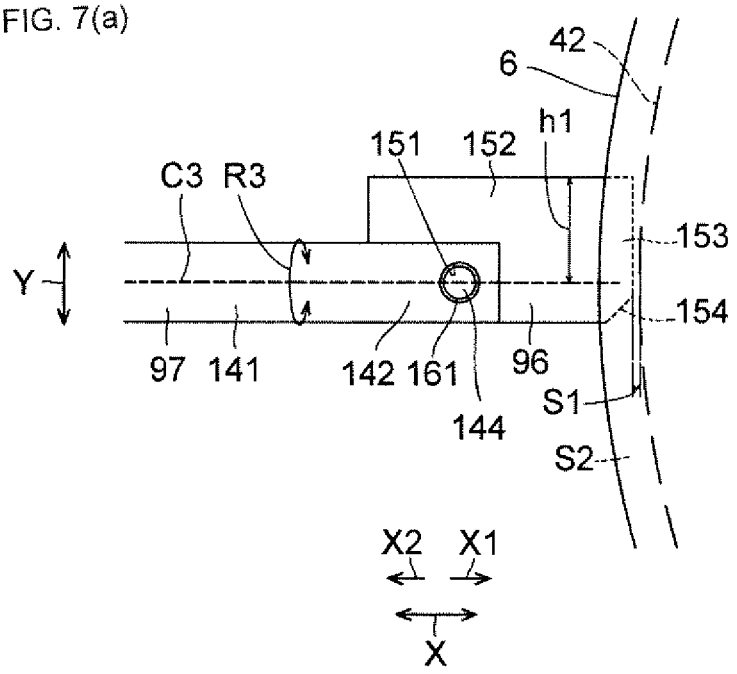
FIG. 7 are explanatory views of an operation of a shaft member of the processing apparatus for brittle plate shown in FIG. 1.
Figure 7B:
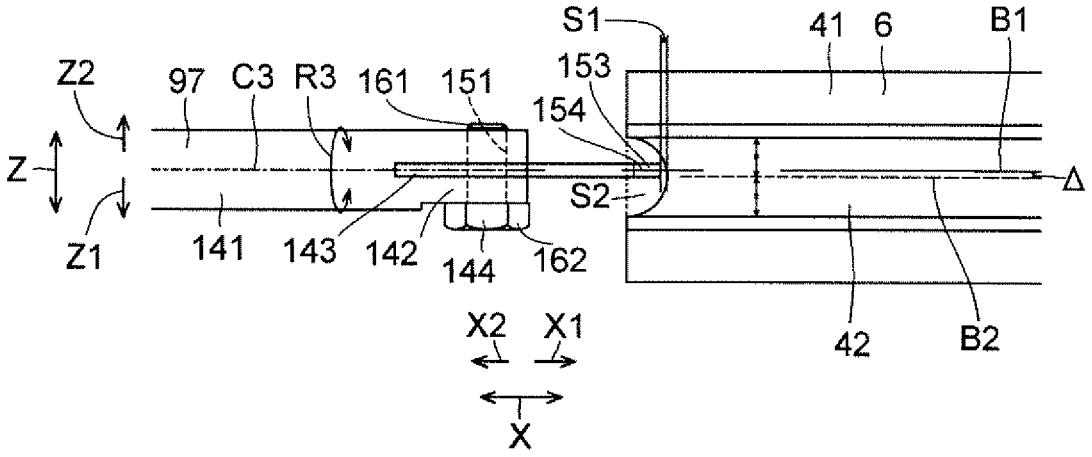
Figure 8:
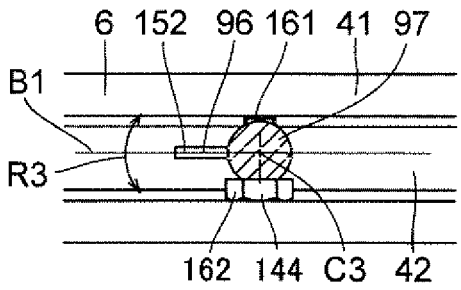
FIG. 8 are explanatory view of a measuring operation of the shaft member of the processing apparatus for brittle plate shown in FIG. 1.
Figure 8:
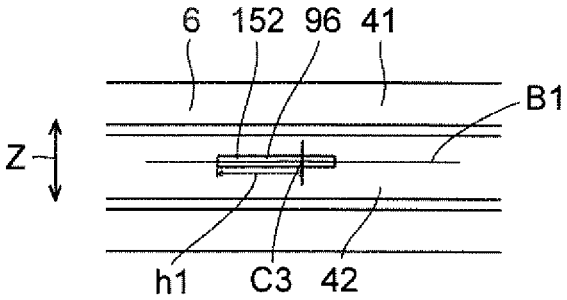
Figure 8:
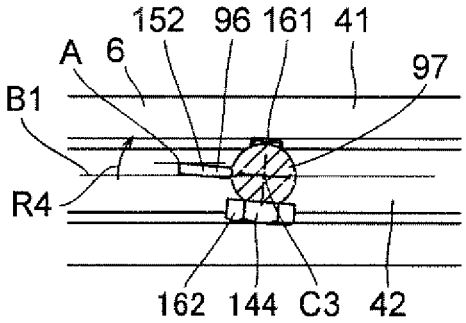
Figure 8:
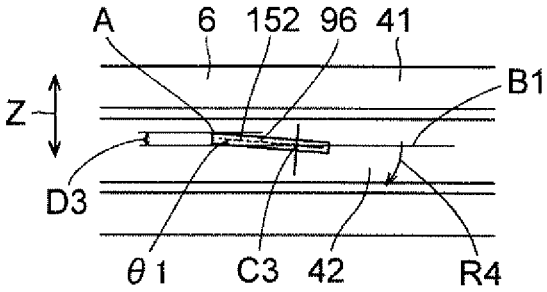
Figure 8:
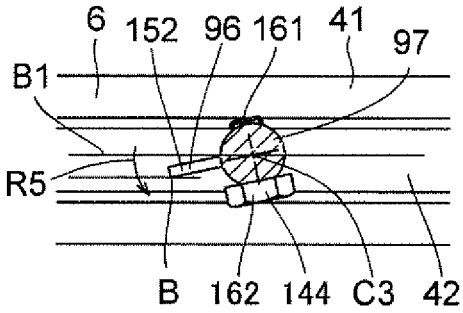
Figure 8:
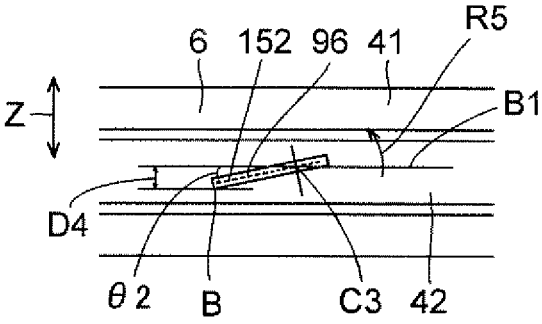

By referring to the drawings attached to FIG. 1, which is a front view of a processing apparatus 1 for brittle plate shown as an example and the like, details of the processing apparatus for brittle plate according to the present invention will be described as follows. FIG. 2 is a partially-omitted planar explanatory view of the processing apparatus 1 for brittle plate, FIG. 3 is a partially-omitted left-side explanatory view of the processing apparatus 1 for brittle plate, FIG. 4 are explanatory views of a processing head 7 of the processing apparatus 1 for brittle plate, and FIG. 5 is a flowchart illustrating a processing method for brittle plate using the processing apparatus 1 for brittle plate. FIG. 6 are explanatory views of an operation of a measuring portion 8 of the processing apparatus 1 for brittle plate, FIG. 7 are explanatory views of an operation of a shaft member 97 of the processing apparatus 1 for brittle plate, FIG. 8 are explanatory views of a measuring operation of the shaft member 97 of the processing apparatus 1 for brittle plate, and in FIG. 1, illustration of an upstream side of the processing apparatus 1 for brittle plate or a carrying-in portion for brittle plate, a scribe, a folding/breaking portion and the like is omitted, for example, in FIG. 2, illustration of a lateral support frame 13 for a base 3, the processing head 7 and the like is omitted, and in FIG. 3, illustration of a table 4, the processing head 7 and the like is omitted. In FIG. 1, a conveying direction of the brittle plate 2 is shown as an X-axis direction, an up-and-down direction as a Z-axis direction, and a direction orthogonal to the X-axis direction and the Z-axis direction as a Y-axis direction.

In FIGS. 1 to 3, the processing apparatus 1 for brittle plate shown as an example includes a base 3, a table 4 provided on the base 3 and holding the rectangular flat-plate shaped brittle plate 2 having a predetermined area defined by an XY plane from a lower surface, the processing head 7 having a processing wheel 6 for processing an outer peripheral edge 5 of the brittle plate 2 held by the table 4, the measuring portion 8 for measuring a positional shift amount Δ in an axis direction of the processing wheel 6 with respect to the brittle plate 2 and in the Z-axis direction orthogonal to the XY plane, and a control portion 9 which corrects a positional shift in the Z-axis direction of the processing wheel 6 on the basis of the positional shift amount Δ in the Z-axis direction of the processing wheel 6 measured by the measuring portion 8 and causes the processing wheel 6 whose positional shift was corrected to process the outer peripheral edge 5 of the brittle plate 2.

In this embodiment, the brittle plate 2 only needs to be a plate having brittleness for an automobile, a liquid crystal panel of a liquid crystal TV and the like, a solar battery, furniture, and construction, for example, types of the brittle plate 2 are wide and diverse, and the brittle plate 2 may be a glass plate, a silicon-carbide plate, a silicone substrate and the like.

In this embodiment, the brittle plate 2 has a rectangular flat-plate shape, but instead of this, the brittle plate 2 may have any shape such as oval, circular, polygonal, square, rectangular and the like, and the brittle plate 2 only needs to have a predetermined area and a predetermined thickness.

The base 3 includes a main body 11 placed on a ground 10, a pair of gate-shaped frames 12 stood on an upper surface of the main body 11 and on both end portions in the X-axis direction, which is a conveying direction of the brittle plate 2, and a lateral support frame 13 extended between the pair of gate-shaped frames 12 and extending in the X-axis direction.

The table 4 is provided on the upper surface of the main body 11, the measuring portion 8 is provided on a gate-shaped frame 12A which is one of the pair of gate-shaped frames 12, and the processing head 7 is provided on the lateral support frame 13.

The table 4 includes a plurality of sucking discs 21 for adsorbing/holding from a lower surface of the brittle plate 2, a sucking-disc base 22 on which the plurality of sucking discs 21 are placed, Y-axis moving means 23 for guiding/moving the sucking-disc base 22 in the Y-axis direction orthogonal to the X-axis direction, and a Cable Bear (Registered Trademark) 24 electrically connected to the Y-axis moving means 23.

In this embodiment, the brittle plate 2 is supported by the plurality of sucking discs 21, but instead of them, the brittle plate 2 may be supported by one sucking disc 21.

The Y-axis moving means 23 includes two guide rails 25 extending in the Y-axis direction and laid in parallel with each other in the Y-axis direction, a slide block 26 attached to each of the guide rails 25 movably in the Y-axis direction and mounted on the lower surface of the sucking-disc base 22, a feed screw 27 screwed with a nut (not shown) fixed to the lower surface of the sucking-disc base 22 and provided between the pair of guide rails 25, and a Y-axis control motor (not shown) for rotating the feed screw 27.

The sucking-disc base 22 moves in the Y-axis direction by rotation of the feed screw 27 by an operation of the Y-axis control motor.

The processing head 7 will be described in detail by referring to FIGS. 4(*a*) to 4(*c*), Note that FIG. 4(*a*) is a partially-omitted front view of the processing head 7, FIG. 4(*b*) is a partially-omitted side view of the processing head 7, and FIG. 4(*c*) is a partially-omitted plan view of the processing head 7.

The processing head 7 includes the pencil-edge type processing wheel 6 for processing the outer peripheral edge 5 of the brittle plate 2, rotating means 31 in which the processing wheel 6 is attached to a lower end in the Z-axis direction and having an output rotating shaft for rotating the processing wheel 6 around an axis C1, a cut-in amount adjusting means 32 for adjusting a cut-in amount of the processing wheel 6 to the brittle plate 2, X-axis moving means 33 for moving the processing wheel 6 in the X-axis direction, Z-axis moving means 34 for moving the processing wheel 6 in the Z-axis direction, turning means 36 having a turning shaft 35 for turning the processing wheel 6 around an axis C2, and a base 39 mounted on a turning shaft holder 38 on a lower end portion 37 of the turning shaft 35 in the turning means 36.

The processing wheel 6 includes a disc-shaped main body 41 and a processing surface 42 containing diamond abrasive grains and the like. Moreover, the processing wheel 6 grinds, polishes or grinds and polishes (hereinafter, referred to as processing) the brittle plate 2 with the processing surface 42.

The processing head 7 and the brittle plate 2 are numerically controlled by the control portion 9 and move on an XY-plane coordinate system, and the processing wheel 6 rotates around the outer periphery of the brittle plate 2 with an angle controlled so as to be directed to a normal direction all the time with respect to the outer peripheral edge 5 of the brittle plate 2, and processes the outer peripheral edge 5 of the brittle plate 2.

The rotating means 31 is a spindle motor having an output rotating shaft 46 in which the processing wheel 6 is mounted on a lower end 45 in the Z-axis direction and rotates the processing wheel 6 in an R1 direction around the rotation axis C1 with the rotation axis C1 of the output rotating shaft 46 as a center by driving of the spindle motor.

The cut-in amount adjusting means 32 includes two cut-in slides 51 mounted on the base 39, extending in the X-axis direction, and laid in parallel with each other, an X-axis direction slide base 52 attached to each of the cut-in slides 51 and capable of relative movement in the X-axis direction, a feed screw 54 screwed with a nut 53 fixed to the X-axis direction slide base 52, a cut-in gear 55 mounted on the feed screw 54, and a cut-in servomotor 58 for adjusting the cut-in amount, having a cut-in gear 56 meshed with the cut-in gear 55 and mounted on the base 39 through a bracket 57.

The control portion 9 operates the cut-in servomotor 58, rotates the feed screw 54 through the cut-in gear 55 and the cut-in gear 56, moves the X-axis direction slide base 52 in the X-axis direction, and adjusts the cut-in amount of the processing wheel 6 with respect to the brittle plate 2.

The processing wheel 6 is constituted such that a peripheral end surface (processing surface 42) thereof matches the rotation axis C2 of the turning shaft 35 by adjustment by the cut-in amount adjusting means 32.

The X-axis moving means 33 includes an X-axis moving base 61 on which the processing head 7 is mounted, a pair of guide rails 63 mounted on a side surface 62 of the lateral support frame 13 and extending in parallel in the X-axis direction, a slider (not shown) slidably fitted with the pair of guide rails 63 and fixed to a rear surface of the x-axis moving base 61, a nut (not shown) mounted on the X-axis moving base 61, a feed screw 64 provided between the pair of guide rails 63 and with which the nut is screwed, and an X-axis servomotor 67 having an output rotating shaft 66 with which the feed screw 64 is linked through a bearing 65.

The processing head 7 is constituted so as to linearly move integrally with the X-axis moving base 61 in the X-axis direction by the X-axis moving means 33, and the linear motion of the X-axis moving base 61 in the X-axis direction rotates the feed screw 64 through the bearing 65 by driving of the X-axis servomotor 67, and the X-axis moving base 61 is moved in the X-axis direction.

The Z-axis moving means 34 includes two guide rails 71 mounted on the X-axis direction slide base 52, extending in the Z-axis direction, and laid in parallel with each other, a Z-axis direction slide base 72 movably attached to each of the guide rails 71 and mounted capable of relative movement in the Z-axis direction with respect to the X-axis direction slide base 52, a feed screw 74 screwed with a nut 73 fixed to the X-axis direction slide base 52, a gear box 75 linked with the feed screw 74, and a Z-axis servomotor 77 having an output rotating shaft 76 linked with the gear box 75 and adjusting a position in the Z-axis direction of the processing wheel 6.

The control portion 9 operates the Z-axis servomotor 77, rotates the feed screw 74, moves the Z-axis direction slide base 72 in the Z-axis direction, and moves the processing wheel 6 in the Z-axis direction.

The processing wheel 6 has a positional shift in the axis direction corrected by adjustment of the Z-axis moving means 34.

The turning means 36 includes a turning servomotor 81 for rotating the processing head 7 around the axis C2, a gear box 82 linked with an output rotating shaft of the turning servomotor 81, the turning shaft 35 having a rotating gear 84 meshed with a rotating gear 83 of the gear box 82, and a bearing case 85 rotatably holding the turning shaft 35.

The turning means 36 is mounted on the X-axis moving base 61 moving in the X-axis, and the turning shaft 35 has the axis C2 thereof incorporated orthogonally to the XY-plane coordinate system, that is, an upper surface of the brittle plate 2.

The processing head 7 is mounted on the turning shaft 35 of the turning means 36 through the base 39 and horizontally and rotationally moved with the axis C2 of the turning shaft 35 as the center, integrally with the turning shaft 35, while an angle is controlled in an R2 direction around the axis C2.

The measuring portion 8 includes a mounting plate 91 mounted on a side surface of one frame 12A in the pair of frames 12, a Z-axis moving base 92 mounted movably in the Z-axis direction on the mounting plate 91, Z-axis moving means 93 for moving the Z-axis moving base 92 in the Z-direction, an X-axis moving base 94 mounted movably in the X-axis direction with respect to the mounting plate 91, X-axis moving means 95 for moving the X-axis moving base 94 in the X-axis direction as a first direction orthogonal to thee axis C1 of the processing wheel 6, rotating means 98 provided on the X-axis moving base 94 and having a shaft member 97 having a distal end portion 96, and a position measurement sensor 99 for measuring a position of the processing surface 44 of the processing wheel 6.

The Z-axis moving base 92 includes a base 101, a plate 104 mounted on the base 101 and having a flange portion 103 extending in the Y-axis direction from one end 102 in the Z-axis direction, and a plate portion 107 having a groove 106 with which a distal end portion 105 in the Y-axis direction of the flange portion 103 is fitted.

In the plate 104 in this embodiment, the flange portion 103 is formed integrally on the one end 102 in the Z-axis direction.

The Z-axis moving means 93 includes one guide rail (not shown) extending in the Z-axis direction and laid in parallel with each other, a slide block (not shown) attached to each of the guide rail (not shown) movably in the Z-axis direction and mounted on the Z-axis moving base 92, a feed screw (not shown) screwed with a nut (not shown) fixed to the lower surface of the Z-axis moving base 92, and a Z-axis control motor 108 for rotating the feed screw.

The X-axis moving base 94 is formed of a plate portion 111 having a predetermined area extending in the X-axis direction, and a Cable-Bear mounting plate 113 for mounting a Cable Bear 112 is mounted on the plate portion 111.

The X-axis moving means 95 includes a rodless air cylinder 123 mounted on one surface 109 in the Y-axis direction of the plate portion 107 and having a slider 121 movable in the X-axis direction, a rodless air-cylinder connecting plate 124 connected to the slider 121 and also connected to the plate portion 111, a guide rail 125 laid on the other surface 110 in the Y-axis direction of the plate portion 107 and extending in the X-axis direction, and a guide block 126 attached movably in the X-axis direction to the guide rail 125 and mounted on the one surface 115 in the Y-axis direction of the plate portion 111.

The X-axis moving means 95 moves the plate portion 111 in the X-axis direction through the rodless air-cylinder connecting plate 124 connected to the slider 121 by driving of the rodless air cylinder 123.

The rotating means 98 includes a servomotor 133 for controlling a torque, mounted on the other surface 116 in the Y-axis direction of the plate portion 111 through a bracket 131 and having an output rotating shaft 132, a shaft member 97 having a distal end portion 96, a coupling 134 for connecting the output rotating shaft 132 and the shaft member 97 to each other, and a bearing case 135 mounted on the other surface 116 in the Y-axis direction of the plate portion 111 and rotatably supporting the shaft member 97.

In this embodiment, the axis of the shaft member 97 and the axis of the output rotating shaft 132 of the servomotor 133 are disposed on an axis C3 (coaxially).

The rotating means 98 rotates the shaft member 97 through the coupling 134 in an R3 direction around the axis C3 by driving of the servomotor 133.

The shaft member 97 includes a shaft body 141 extending in the X-axis direction, a notched portion 143 provided on one end portion 142 of the shaft body 141 in the X-axis direction, the distal end portion 96 inserted and held by the notched portion 143, and fixing means 144 for fixing the distal end portion 96 to the shaft body 141.

The distal end portion 96 is formed of a hard material and includes a rectangular distal-end portion body 152 having a through hole 151 and a distal-end portion notched part 154 formed in an end portion 153 of the distal-end portion body 152 in the axis C3 direction.

The distal end portion 96 only needs to be formed of a hard material, and the distal end portion 96 is formed of a stainless hard material in this embodiment.

The fixing means 144 is formed of a screw body 161 in which a male thread part (not shown) is formed on an outer peripheral surface and a head portion 162 provided on one end of the screw body 161, and in the through hole 151 of the shaft member 97, a female thread part (not shown) formed on an inner peripheral surface defining the through hole 151 is formed, and the fixing means 144 fixes the distal end portion 96 to the shaft member 97 by penetrating the screw body 161 through the through hole 151 and by screwing the male thread part with the female thread part of the through hole.

The position measurement sensor 99 includes a contact sensor 172 mounted on the other surface 116 in the Y-axis direction of the plate portion 111 through a bracket 171 and a stopper 174 mounted on the other surface 116 in the Y-axis direction of the plate portion 111 through the bracket 171 and brought into contact with one side surface 173 in the Y-axis direction of the flange portion 103.

Regarding the x-axis moving base 94, in the X1 direction which is one direction in the X-axis direction by the rodless air cylinder 123, first, the contact sensor 172 is brought into contact with the side surface 173 of the flange portion 103, and then, the X-axis moving base 94 further moves in the X1 direction, whereby the stopper 174 is brought into contact with the side surface 173 of the flange portion 103, and the movement in the X1 direction is stopped.

The X-axis moving base 94 is biased in the X1 direction by an elastic force by an air pressure by the rodless air cylinder 123 in a state where the contact sensor 172 and the stopper 174 are in contact with the side surface 173 of the flange portion 103.

The contact sensor 172 is connected to the control portion 9, and the control portion 9 moves the X-axis moving base 94 in an X2 direction by movement of the processing head 7 in the X2 direction. The control portion 9 stops the movement of the processing head 7 in the X1 direction when a movement amount set in advance in the contact sensor 172 is reached in the movement of this X-axis moving base 94 in the X2 direction.

The contact sensor 172 is a contact-type sensor in this embodiment, but in place of this, a digital dial gauge, a laser displacement sensor, a non-contact sensor or the like which detects displacement electrically or optically may be used, for example.

The stopper 174 can adjust a distance until the stopper 174 is brought into contact with the side surface 173 of the flange portion 103 by adjusting a protruding amount in the X1 direction from the bracket 171.

The control portion 9 includes arithmetic processing (processing) means 181 such as a CPU (Central Processing Unit) or the like and a memory (memory) means 182 such as a flash memory or the like. For example, the control portion 9 may be a computer (computer) such as a microprocessor, or the control portion 9 may be a virtual server constructed in a cloud or a physical computer installed in a machine room or the like. Moreover, the control portion 9 may be configured by a single computer, may be configured by a plurality of computers linked with each other, or may be configured by a cloud which is a collection of computer resources.

The control portion 9 is connected to the table 4, the processing head 7, motors required for driving the measuring portion 8 and the processing apparatus 1 for brittle plate, the rodless air cylinder, the Cable Bear and the like and controls them through numerical control instructions programmed in advance. Since the control portion 9 as above is well-known, detailed description thereof is omitted.

The memory means 182 is a recording medium including a ROM (Read Only Memory), a RAM (Random Access Memory), a hard disk drive and the like. The memory means 182 stores a program executed by the control portion 9 in advance. The memory means 182 may be provided outside the processing apparatus 1 for brittle plate and in that case, transmission/reception of data with the control portion 9 may be performed via a network.

In this embodiment, each of the table 4, the processing head 7, and the measuring portion 8 is numerically controlled individually or each of the table 4, the processing head 7, and the measuring portion 8 may be numerically controlled in synchronization.

Subsequently, by referring to FIGS. 5 to 8, a processing method for brittle plate for processing the brittle plate 2 by using the processing apparatus 1 for brittle plate will be described. The following operation of the processing apparatus 1 for brittle plate is controlled by the control portion 9. Moreover, FIG. 5 is a flowchart illustrating the processing method for brittle plate for processing the brittle plate 2 by using the processing apparatus 1 for brittle plate in this embodiment.

As shown in FIG. 5, the processing method for brittle plate includes a positioning process S101 of positioning the shaft member 97 to a predetermined position, a first measuring process S102 of rotating the shaft member 97 in an R4 direction which is a first rotating direction in the R3 direction around the axis C3 so as to bring the distal end portion 96 into contact with the processing surface 42 of the processing wheel 6 and of measuring a first position A on the processing surface 42 of the processing wheel 6 with which the distal end portion 96 is in contact, a second measuring process S103 of rotating the shaft member 97 in an R5 direction which is a second rotating direction opposite to the R4 direction which is the first rotating direction in the R3 direction around the axis C3 so as to bring the distal end portion 96 into contact with the processing surface 42 of the processing wheel 6 and of measuring a second position B on the processing surface 42 of the processing wheel 6 with which the distal end portion 96 is in contact, a calculating process S104 of calculating a first distance D3 from a predetermined processing reference position B1 to the first position A in the Z-axis direction of the processing wheel 6, of calculating a second distance D4 from the predetermined processing reference position B1 to the second position B in the Z-axis direction of the processing wheel 6, and of calculating a positional shift amount Δ in the Z-axis direction of the processing wheel 6 with respect to the brittle plate 2 on the basis of the first distance D3 and the second distance D4, a correcting process S105 of correcting a positional shift in the Z-axis direction of the processing wheel 6 on the basis of the positional shift amount Δ in the Z-axis direction of the processing wheel 6, and a processing process S106 of causing the processing wheel 6 after the correcting process to process the outer peripheral edge 5 of the brittle plate 2.

First, as the positioning process S101, the brittle plate 2 to be processed is placed above the table 4 and positioned by vacuum sucking/supporting the brittle plate 2 by the sucking discs 21 of the table 4.

The Z-axis moving table 92 is moved in the Z-axis direction by the Z-axis moving means 93 so that the axis C3 of the shaft member 97 is positioned to the predetermined processing reference position B1. In this embodiment, the predetermined processing reference position B1 is a position where the brittle plate 2 is divided into halves in the Z-axis direction (thickness direction of the brittle plate 2).

As shown in FIGS. 6(*a*) and 6(*b*), the X-axis moving means 95 is driven, whereby the X-axis moving base 94 is moved in the X1 direction, the shaft member 97 after the positioning to the processing reference position B1 is moved in the X1 direction, the contact sensor 172 is brought into contact with the side surface 173 of the flange portion 103, the x-axis moving base 94 is further moved in the X1 direction, the stopper 174 is brought into contact with the side surface 173 of the flange portion 103, and the movement of the x-axis moving base 94 in the X1 direction is stopped (limited).

As shown in FIGS. 6(*b*) and 6(*c*), in a state where the contact sensor 172 is in contact with the side surface 173 of the flange portion 103, the stopper 174 is in contact with the side surface 173 of the flange portion 103, and the movement of the X-axis moving base 94 in the X1 direction is stopped (limited), the processing wheel 6 is moved in the X2 direction by the X-axis moving means 33, and the processing surface 42 of the processing wheel 6 is gradually brought closer to the shaft member 97.

The control portion 9 gradually moves the processing wheel 6 in the X2 direction, brings the processing surface 42 of the processing wheel 6 closer to the end portion 153 of the distal-end portion body 152, and the processing wheel 6 is further moved in the X2 direction by a countervailing force in the X2 direction opposite to a direction of the air pressure in the X1 direction of the rodless air cylinder 123.

The processing wheel 6 is moved in the X2 direction in a state where the end portion 153 of the distal-end portion body 152 is in contact with the processing surface 42.

The control portion 9 stops the movement of the processing wheel 6 in the X2 direction when the horizontal distance D1 by which the contact sensor 172 is moved by the processing wheel 6 from the side surface 173 of the flange portion 103 in the X2 direction reaches the movement amount set in advance in the contact sensor 172.

At this time, the processing surface 42 of the processing wheel 6 and the end portion 153 of the distal-end portion body 152 maintain a contact state. The horizontal distance D1 by which the contact sensor 172 is moved in the X2 direction is equal to the horizontal distance D2 by which the processing wheel 6 is moved in the X2 direction.

After the movement of the processing wheel 6 in the X2 direction is stopped, the state where the processing surface 42 of the processing wheel 6 and the end portion 153 of the distal-end portion body 152 are in contact is maintained, the processing wheel 6 is moved in the X1 direction on the basis of the movement amount set in advance in the contact sensor 172.

As described above, the control portion 9 measures the position where the processing surface 42 is in contact with the end portion 153 of the distal-end portion body 152 and acquires position information.

In order to cause the processing surface 42 of the processing wheel 6 faced to the end portion 153 of the distal-end portion body 152 with a predetermined clearance S1, the processing wheel 6 is further moved in the xl direction.

As shown in FIGS. 7, the predetermined clearance 51 may be such a degree that the end portion 153 of the distal-end portion body 152 is not in contact with the processing surface 42 of the processing wheel 6, or the clearance S1 is preferably approximately 0.1 to 0.5 mm or more preferably it is 0.3 mm. The clearance S1 can be changed depending on a shape of the processing surface 42.

The end portion 153 of the distal-end portion body 152 is located in an annular space 52 defined by an outer profile and the processing surface 42 of the processing wheel 6 in a radial direction.

Subsequently, a measuring operation of the shaft member 97 will be described in detail by referring to FIG. 8(*a*1) to 8(*a*3) and FIGS. 8(*b*1) to 8(*b*3). Note that FIGS. 8(*a*1) to 8(*a*3) are partially-omitted sectional views of the shaft member 97, and FIGS. 8(*b*1) to 8(*b*3) are partially-omitted side views of the distal end portion 96.

As the first measuring process S102, as shown in FIGS. 8(*a*1) to 8(*a*2) and FIGS. 8(*b*1) to 8(*b*2), the measuring portion 8 causes the shaft member 97 to be rotated in the R4 direction so that the end portion 153 of the distal-end portion body 152 is brought into contact with the processing surface 42 of the processing wheel 6 and measures a positional coordinate of the first position A where the end portion 153 of the distal-end portion body 152 is rotated in the R4 direction and is brought into contact with the processing surface 42 of the processing wheel 6.

Subsequently, as shown in FIG. 8(*a*3) and FIG. 8(*b*3), as the second measuring process 103, the measuring portion 8 causes the shaft member 97 to be rotated in the R5 direction so that the end portion 153 of the distal-end portion body 152 is brought into contact with the processing surface 42 of the processing wheel 6 and measures a positional coordinate of the second position B where the end portion 153 of the distal-end portion body 152 is rotated in the R5 direction and is brought into contact with the processing surface 42 of the processing wheel 6

Subsequently, as the calculating process S104, the control portion 9 calculates the first distance D3 in the Z-axis direction of the processing wheel 6 from the predetermined processing reference position B1 to the first position A, and calculates the second distance D4 in the Z-axis direction of the processing wheel 6 from the predetermined processing reference position B1 to the second position B. For example, the first distance D3 is calculated from an angle θ1 formed by the distal-end portion body 152 and the processing reference position B1 and a length hl in the Y-axis direction of the distal-end portion body 152, and the second distance D4 is calculated from an angle 62 formed by the distal-end portion body 152 and the processing reference position B1 and the length hl in the Y-axis direction of the distal-end portion body 152. Moreover, the angle θ1 and the angle θ2 may be calculated from the servomotor 133.

On the basis of the first distance D3 and the second distance D4, the positional shift amount Δ in the Z-axis direction of the processing wheel 6 with respect to the brittle plate 2 is calculated.

The calculation of the positional shift amount Δ is executed by the arithmetic processing means 181. In the calculation by the arithmetic processing means 181, the positional shift amount Δ is acquired by the positional shift amount Δ (correction amount)=((D3+D4)/2-D3), in the case of D3<D4, for example.

Subsequently, as the correcting process S105, the control portion 9 causes the Z-axis moving means 34 to be driven on the basis of the positional shift amount Δ by the arithmetic processing means 181, moves the processing wheel 6 in a Z2 direction (upward) which is the other in the Z-axis direction, and corrects the positional shift (positional shift from the predetermined processing reference position B1 of the brittle plate 2 to the position B2 dividing the processing surface 42 of the processing wheel 6 into halves in the Z-axis direction) in the Z-axis direction of the processing wheel 6.

Subsequently, as the processing process S106, the processing wheel 6 whose positional shift was corrected is caused to process the outer peripheral edge 5 of the brittle plate 2.

According to the processing method for brittle plate in this embodiment, since the shaft member 97 having the distal end portion 96 of the rotating means 31 is inserted into the annular space S2 of the processing surface 42 of the processing wheel 6, the shaft member 97 is rotated in the R4 direction and in the R5 direction, and the positional coordinates (the first position A and the second position B) where the distal end portion 96 is in contact with the processing surface 42 of the processing wheel 6 are measured, respectively, the positional shift amount Δ in the Z-axis direction of the processing wheel 6 is automatically calculated by the control portion 9 by the positional coordinates from the processing reference position B1, and the positional shift in the Z-axis direction of the processing wheel 6 can be automatically corrected, the manual positioning of the processing wheel 6 performed at each replacement of the processing wheel 6, for example, can be automated, labor and time for the manual positioning of the processing wheel 6 with respect to the brittle plate 2 after the replacement of the processing wheel 6 can be reduced, and efficiency of the processing of the brittle plate as a whole can be made high.

According to another example of this embodiment, in the processing method for brittle plate, by repeating the first measuring process S102, the second measuring process S103, the calculating process S104, and the correcting process S105 in order several times, the positional shift amount Δ in the Z-axis direction of the processing wheel 6 with respect to the brittle plate 2 can be brought closer to 0 as much as possible, the positional shift in the Z-axis direction of the processing wheel 6 is eliminated, the processing surface 42 of the processing wheel 6 corrected several times is brought into contact with the brittle plate 2 with accuracy, and the brittle plate 2 can be processed with high accuracy. In another example of this embodiment, in the processing method for brittle plate, each process from the first measuring process S102 to the correcting process S105 may be preferably repeated in order from twice to five times, or more preferably, the processes from the first measuring process S102 to the correcting process S105 may be repeated in order three times so that the positional shift amount Δ in the Z-axis direction of the processing wheel 6 with respect to the brittle plate 2 can be brought closer to 0 as much as possible. Moreover, in order to reduce the positional shift in the Z-axis direction of the processing wheel 6 with respect to the brittle plate 2, the first measuring process S102, the second measuring process S103, the calculating process S104, and the correcting process S105 may be further repeated in order.

According to another example of this embodiment, in the processing method for brittle plate, in the processing wheel 6 whose positional shift in the Z-axis direction was corrected after the correcting process S105 or in the processing wheel 6 whose positional shift was corrected several times by repeating each process from the first measuring process S102 to the correcting process S105 in order several times, in a state where the control portion 9 causes the X-axis moving means 95 to be driven, causes the X-axis moving base 94 to move in the X1 direction, causes the shaft member 97 after the positioning to the processing reference position B1 to move in the X1 direction, causes the contact sensor 172 and the stopper 174 to be brought into contact with the side surface 173 of the flange portion 103, stops (limits) the movement of the X-axis moving table 94 in the X1 direction so that the movement of the X-axis moving base 94 in the X1 direction is stopped (limited), the processing wheel 6 is moved by the X-axis moving means 33 in the X2 direction, the processing surface 42 of the processing wheel 6 is gradually brought closer (moved) to the shaft member 97, the processing surface 42 of the processing wheel 6 is brought into contact with the end portion 153 of the distal-end portion body 152, the processing wheel 6 is further moved in the X2 direction by the countervailing force in the X2 direction which is the direction opposite to the air pressure of the rodless air cylinder 123 in the X1 direction, and when the horizontal distance D1 by which the sensor 172 is moved in the X2 direction from the side surface 175 of the flange portion 103 of the sensor 172 reaches the movement amount set in advance in the contact sensor 172, the movement of the processing wheel 6 in the X2 direction is stopped, and after the movement of the processing wheel 6 in the X2 direction is stopped, while the state where the processing surface 42 of the processing wheel 6 and the end portion 153 of the distal-end portion body 152 are in contact is maintained, on the basis of the movement amount set in advance in the contact sensor 172, by moving the processing wheel 6 in the X1 direction, the control portion 9 can measure the position where the processing surface 42 of the processing wheel 6 whose positional shift in the Z-axis direction was corrected is brought into contact with the end portion 153 of the distal-end portion body 152, acquire the position information, and cause the processing surface 42 of the processing wheel 6 to be brought into contact with the outer peripheral edge 5 of the brittle plate 2 with accuracy on the basis of this position information and valued set in the control portion 9 in advance, that is, information set in advance such as dimensions of the processing wheel 6, the shaft member 97, the distal end portion 96 and the like, for example, and thus, accurate cut-in can be performed in the brittle plate 2 by the processing wheel 6 whose positional shift in the Z-axis direction was corrected after the correcting process S105 or the processing wheel 6 whose positional shift was corrected several times by repeating each process from the first measuring process S102 to the correcting process S105 in order several times.

Figure 9:
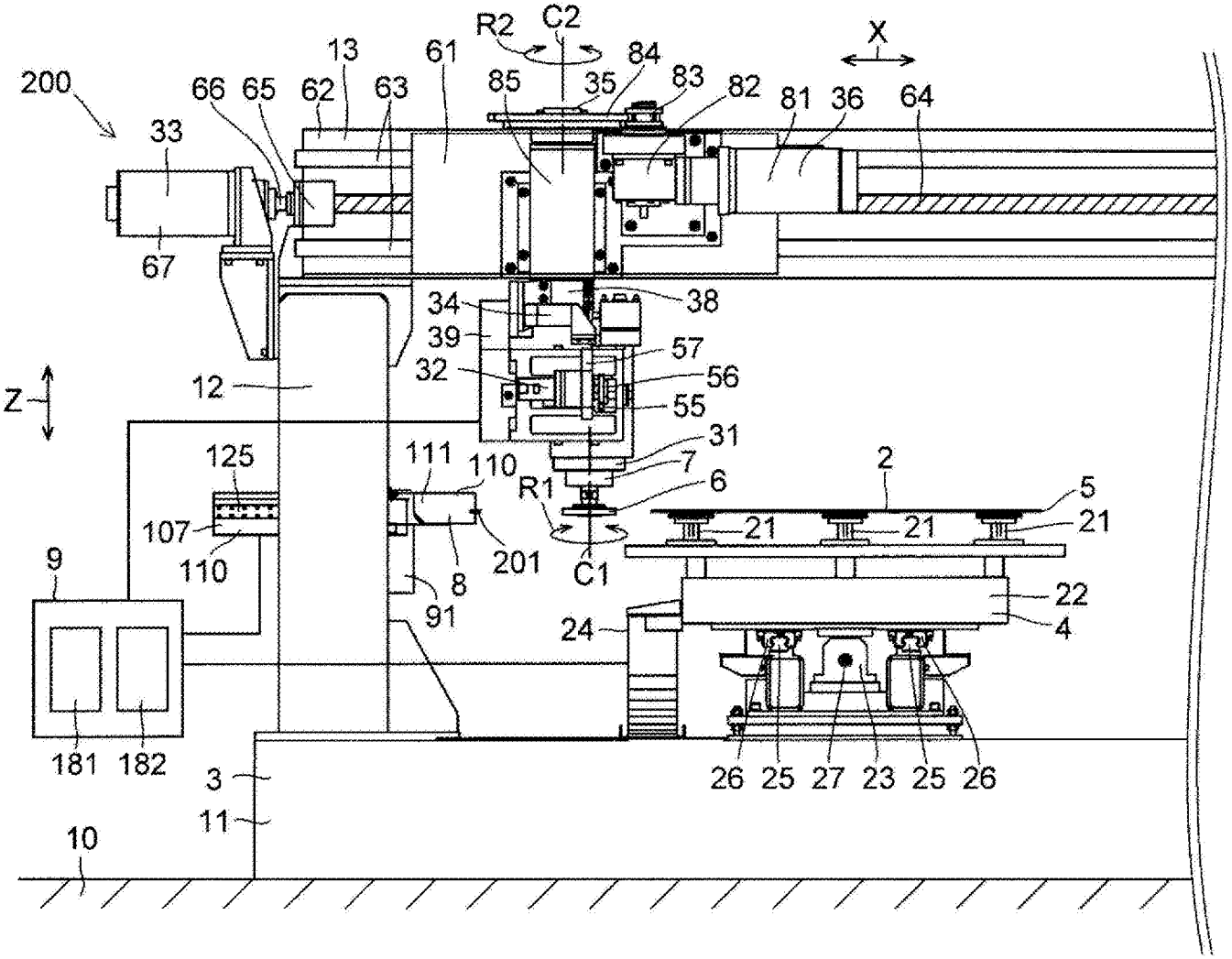
FIG. 9 is a front view of a processing apparatus for brittle plate shown as another example.
Figure 10:
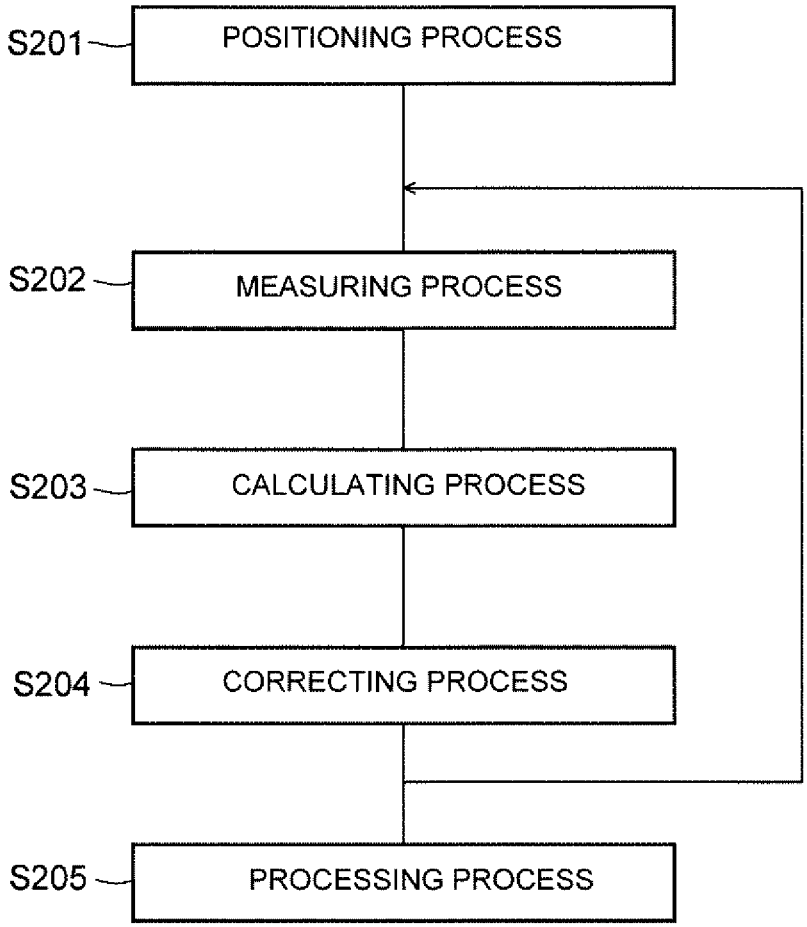
FIG. 10 is a flowchart illustrating a processing method for brittle plate using the processing apparatus for brittle plate shown in FIG. 9.

By referring to the drawings attached to FIG. 9 which is a front view of a processing apparatus 200 for brittle plate and the like illustrated as another example, details of the processing apparatus 200 for brittle plate according to the present invention will be described as follows. FIG. 10 is a flowchart illustrating a processing method for brittle plate of the processing apparatus 200 for brittle plate. Moreover, the processing apparatus 200 for brittle plate shown in FIG. 9 is different from that in FIG. 1 in a point that, instead of the rotating means 98 and the position measurement sensor 99, laser measuring means 201 is used. The other constitutions of this processing apparatus 200 for brittle plate are the same as those of the processing apparatus 1 for brittle plate in FIG. 1 and thus, by giving the same signs as those in FIG. 1 and by incorporating the explanation in FIG. 1, the detailed description of the other constitutions of this processing apparatus 1 for brittle plate will be omitted.

The laser measuring means 201 is provided on the X-axis moving base 94 and measures the processing surface 42 by emitting a laser to the processing surface 42 of the processing wheel 6.

A measurement range of the laser measuring means 201 is different depending on a type of the laser measuring means 201, but in the case of a middle-range type of CL-3000 series by KEYENCE (CL-L070/CL-P070), its measurement range is 70 mm±10 mm, in the case of the middle-range type of the LJ-G5000 series (LJ-G080), its measurement range is 80 mm±23 mm, and in the case of the highly accurate one (LJ-G030) of the LJ-G5000 series, its measurement range is 80 mm±23 mm. Moreover, the types of the laser measuring means 201 are not particularly limited to them, but they can be selected and used as appropriate in accordance with the applications.

Moreover, the laser measuring means 201 can conduct various measurements such as a height (peak height, bottom height, average height), a width, a position, a step, an angle, an intersection, a shape, a sectional area, shape comparison and the like, for example, can conduct momentary measurement of a predetermined region or an entire region and can measure a position where a distance in the X-axis direction from the laser measuring means 201 to the processing surface 42 of the processing wheel 6 becomes the maximum in this embodiment.

The control portion 9 calculates a position where the distance in the X-axis direction from the laser measuring means 201 to the processing surface 42 of the processing wheel 6 becomes the maximum by a measured value measured by the laser measuring means 201, calculates the positional shift amount Δ in the Z-axis direction of the processing wheel 6 on the basis of the position (center B2 in the Z-axis direction of the processing wheel 6) where the distance from the laser measuring means 201 to the processing surface 42 of the processing wheel 6 becomes the maximum, and the processing reference position B1, corrects the positional shift in the Z-axis direction of the processing wheel 6 on the basis of the positional shift amount Δ in the Z-axis direction of the processing wheel 6, and causes the processing wheel 6 whose positional shift was corrected to process the outer peripheral edge 5 of the brittle plate 2.

Subsequently, by referring to FIG. 10, a processing method for brittle plate for processing the brittle plate 2 by the processing apparatus 200 for brittle plate in this embodiment will be described. The following operations of the processing apparatus 200 for brittle plate are controlled by the control portion 9. Moreover, FIG. 10 is a flowchart illustrating the processing method for brittle plate for processing the brittle plate 2 by using the processing apparatus 200 for brittle plate in this embodiment.

As shown in FIG. 10, the processing method for brittle plate includes a positioning process 8201 of positioning the laser measuring means 201 to a predetermined position, a measuring process 8202 of measuring the processing surface 42 of the processing wheel 6 by emitting a laser beam of the laser measuring means 201 to the processing surface 42 of the processing wheel 6, a calculating process s203 of calculating the positional shift amount Δ in the Z-axis direction of the processing wheel 6 on the basis of a measured value measured by the laser measuring means 201, a correcting process S204 of correcting the positional shift in the Z-axis direction of the processing wheel 6 on the basis of the positional shift amount Δ in the Z-axis direction of the processing wheel 6, and a processing process s205 of causing the processing wheel 6 after the correcting process to process the outer peripheral edge 5 of the brittle plate 2.

First, as the positioning process S201, the brittle plate 2 to be processed is placed above the table 4 and positioned by vacuum sucking/supporting the brittle plate 2 by the sucking discs 21 of the table 4.

In order to dispose the processing surface 42 of the processing wheel 6 in a range where measurement can be made by the laser measuring means 201, the Z-axis moving means 93 is driven, the position in the Z-axis direction of the Z-axis moving base 92 is adjusted, the X-axis moving means 95 is driven, the X-axis moving base 94 is moved in the X1 direction, and the laser measuring means 201 is brought closer to the processing wheel 6 in the measurement range of the laser measuring means 201.

Subsequently, as the measuring process S202, the laser measuring means 201 measures the processing surface 42 of the processing wheel 6 by emitting a laser beam to the processing surface 42 of the processing wheel 6.

Subsequently, as the calculating process s203, the control portion 9 calculates the positional shift amount Δ in the Z-axis direction of the processing wheel 6 on the basis of the measured value measured by the laser measuring means 201.

The calculation of the positional shift amount Δ is performed by the arithmetic processing means 181.

Subsequently, as the correcting process s204, the control portion 9 causes the Z-axis moving means 34 to be driven on the basis of the positional shift amount Δ by the arithmetic processing means 181 so as to correct the positional shift in the Z-axis direction of the processing wheel 6.

Subsequently, as the processing process s205, the processing wheel 6 whose Z-positional shift was corrected is caused to process the outer peripheral edge 5 of the brittle plate 2.

According to the processing method for brittle plate of an example of this another embodiment, since the positional shift in the Z-axis direction of the processing wheel 6 can be automatically corrected by automatically calculating the positional shift amount Δ in the Z-axis direction of the processing wheel 6 by the laser measuring means 201 easily, for example, the manual positioning of the processing wheel 6 performed at each replacement of the processing wheel 6 can be automated, labor and time for the manual positioning of the processing wheel 6 with respect to the brittle plate 2 after the replacement of the processing wheel 6 can be reduced, and efficiency of the processing of the brittle plate as a whole can be made high.

According to an example of this another embodiment, in the measuring process s202, in the state where the laser measuring means 201 emits the laser to the processing surface 42 of the processing wheel 6, time for measurement of the processing surface 42 of the processing wheel 6 can be reduced by relative movement of at least either one of the processing wheel 6 and the laser measuring means 201 from one to the other in the Z-axis direction and thus, for example, the manual positioning of the processing wheel 6 with respect to the brittle plate 2 performed at each replacement of the processing wheel 6 can be automated, and time for the positioning of the processing wheel 6 with respect to the brittle plate 2 can be drastically reduced.

According to another example of this another embodiment, in the measuring process s202, since the laser measuring means 201 can measure the processing surface 42 of the processing wheel 6 by emitting the laser to at least one predetermined region, a plurality of predetermined regions or the entire region on the processing surface 42 of the processing wheel 6 in the Z-axis direction, time for measurement of the processing surface 42 of the processing wheel 6 can be reduced, for example, the manual positioning of the processing wheel 6 performed at each replacement of the processing wheel 6 can be automated, and time for the positioning of the processing wheel 6 can be drastically reduced. The predetermined region only needs to have an irradiation width of the laser to the processing surface 42 of the processing wheel 6 in the Z-axis direction, and it may be a region having one width or a region having a plurality of widths.

According to another example of this another embodiment, in the measuring process s202, the processing surface 42 of the processing wheel 6 can be measured at the same time by emitting the laser at the same time to a predetermined region on the processing surface 42 of the processing wheel 6 in the Z-axis direction or arbitrary 8 spots on the processing surface 42 of the processing wheel 6 in the Z-axis direction, for example, and moreover, in the measuring process s202, the processing surface 42 of the processing wheel 6 can be measured at the same time by emitting the laser at the same time to the entire region on the processing surface 42 of the processing wheel 6 in the Z-axis direction.

In the examples of the processing apparatus 1 for brittle plate and the processing apparatus 200 for brittle plate, the measuring portion 8 is constituted to include the Z-axis moving base 92 mounted movably in the Z-axis direction on the mounting plate 91 and the Z-axis moving means 93 for moving the Z-axis moving base 92 in the Z-direction, but instead of this, the measuring portion 8 may be mounted immovably in the Z-axis direction in a state positioned to the frame 12A in the Z-axis direction without including the Z-axis moving base 92 and the Z-axis moving means 93.

REFERENCE SIGNS LIST

1 Processing apparatus for brittle plate
2 Brittle plate
3 Base
4 Table
5 Outer peripheral edge
6 Processing wheel
7 Processing head
8 Measuring portion
9 Control portion
10 Ground
11 Main body
12 Frame
12A Frame
13 Lateral support frame
21 Sucking disc
22 Sucking-disc base
23 Y-axis moving means
24 Cable Bear
25 Guide rail
26 Slide block
27 Feed screw
31 Rotating means
32 Cut-in amount adjusting means
33 X-axis moving means
34 Z-axis moving means
35 Turning shaft
36 Turning means
37 Lower end portion
38 Turning holder
39 Base
41 Main body
42 Processing surface
45 lower end
46 Output rotating shaft
51 Cut-in slide
52 X-axis direction slide base
53 Nut
54 Feed screw
55 Cut-in gear
56 Cut-in gear
57 Bracket
58 Cut-in servomotor
61 X-axis moving base
62 Side surface
63 Guide rail
64 Feed screw
65 Bearing
66 Output rotating shaft
67 X-axis servomotor
71 Guide rail
72 Z-axis direction slide base
73 Nut
74 Feed screw
75 Gear box
76 Output rotating shaft
77 Z-axis servomotor
81 Turning servomotor
82 Gear box
83 Rotating gear
84 Rotating gear
85 Bearing case
91 Mounting base
92 Z-axis moving base
93 Z-axis moving means
94 X-axis moving base
95 X-axis moving means
96 Distal end portion
97 Shaft member
98 Rotating means
99 Position measurement sensor
101 Base
102 One end
103 Flange portion
104 Plate
105 Distal end portion
106 Groove
107 Plate portion
108 Z-axis control motor
109 Surface

110 Surface
111 Plate portion
112 Cable Bear
113 Cable-Bear mounting plate
115 Surface
116 Surface
121 Slider
123 Rodless air cylinder
124 Rodless air-cylinder connecting plate
125 Guide rail
126 Guide block
131 Bracket
132 output rotating shaft
133 Servomotor
134 Coupling
135 Bearing case
141 Shaft body
142 End portion
143 notched portion
144 Fixing means
151 Through hole
152 Distal-end portion body
153 End portion
154 Distal-end portion notched part
161 Screw body
162 Head portion
171 Bracket
172 Contact sensor
173 Side surface
174 Stopper
181 Arithmetic processing means
182 Memory means
200 Processing apparatus for brittle plate
201 Laser measuring means

The invention claimed is:

1. A processing apparatus for brittle plate, comprising:

a table which holds the brittle plate, a processing head having a processing wheel for processing an outer peripheral edge of the brittle plate held by the table, a measuring portion which measures a positional shift amount in an axis direction of the processing wheel with respect to the brittle plate, and a control portion which corrects a positional shift in the axis direction of the processing wheel on the basis of the positional shift amount in the axis direction of the processing wheel measured by the measuring portion and causes the processing wheel whose positional shift was corrected to process the outer peripheral edge of the brittle plate, and wherein said measuring portion includes:

a mounting plate, a moving base provided capable of relative movement with respect to the mounting plate in a first direction orthogonal to an axis of the processing wheel, a moving portion for moving the moving base in the first direction, and a rotating portion provided on the moving base and having a shaft member including a distal end portion;

the measuring portion causes the shaft member to be rotated in a first rotating direction and causes the distal end portion to be brought into contact with a processing surface of the processing wheel, measures a first position where the distal end portion is rotated in the first rotating direction and is brought into contact with the processing surface of the processing wheel, causes the shaft member to be rotated in a second rotating direction which is a direction opposite to the first rotating direction and causes the distal end portion to be brought into contact with the processing surface of the processing wheel, and measures a second position where the distal end portion is rotated in the second rotating direction and is brought into contact with the processing surface of the processing wheel; and the control portion calculates a first distance from a predetermined processing reference position to the first position in the axis direction of the processing wheel, calculates a second distance from the predetermined processing reference position to the second position in the axis direction of the processing wheel, calculates the positional shift amount in the axis direction of the processing wheel on the basis of the first distance and the second distance, corrects the positional shift in the axis direction of the processing wheel on the basis of the positional shift amount in the axis direction of the processing wheel, and causes the processing wheel whose positional shift was corrected to process the outer peripheral edge of the brittle plate.

2. The processing apparatus for brittle plate according to claim 1, wherein the processing apparatus for brittle plate alternately repeats measurement of the first position and the second position by the measuring portion and correction of the positional shift in the axis direction of the processing wheel by the control portion several times and causes the processing wheel whose positional shift was corrected several times to process the outer peripheral edge of the brittle plate.

3. The processing apparatus for brittle plate according to claim 1, wherein the rotating portion is a servomotor which controls a torque.

4. A processing method for brittle plate using a processing apparatus for brittle plate, including:

a table which holds the brittle plate, a processing head having a processing wheel for processing an outer peripheral edge of the brittle plate held by the table, a measuring portion which measures a positional shift amount in an axis direction of the processing wheel with respect to the brittle plate, and a control portion which corrects a positional shift in the axis direction of the processing wheel on the basis of the positional shift amount in the axis direction of the processing wheel measured by the measuring portion and causes the processing wheel whose positional shift was corrected to process the outer peripheral edge of the brittle plate, the measuring portion including:

a mounting plate, a moving base provided capable of relative movement with respect to the mounting plate in a first direction orthogonal to the axis of the processing wheel, a moving portion for moving the moving base in the first direction, and a rotating portion provided on the moving base and having a shaft member including a distal end portion, and the processing method for brittle plate, comprising:

a positioning process of positioning the shaft member to a predetermined position, a first measuring process of bringing the distal end portion into contact with the processing surface of the processing wheel by rotating the shaft member in a first rotating direction around a shaft thereof and of measuring a first position on the processing surface of the processing wheel with which the distal end portion is brought into contact, a second measuring process of bringing the distal end portion into contact with the processing surface of the processing wheel by rotating the shaft member in a second rotating direction which is a direction opposite to the first rotating direction and of measuring a second position on the processing surface of the processing wheel with which the distal end portion is brought into contact, a calculating process of calculating a first distance in the axis direction of the processing wheel from a predetermined processing reference position to the first position, of calculating a second distance in the axis direction of the processing wheel from the predetermined processing reference position to the second position, and of calculating the positional shift amount in the axis direction of the processing wheel on the basis of the first distance and the second distance, a correcting process of correcting the positional shift in the axis direction of the processing wheel on the basis of the positional shift amount in the axis direction of the processing wheel, and a processing process of causing the processing wheel whose positional shift was corrected after the correcting process to process the outer peripheral edge of the brittle plate.

5. The processing method for brittle plate according to claim 4, wherein the first measuring process, the second measuring process, the calculating process, and the correcting process are repeated several times, and the processing wheel whose positional shift was corrected several times is caused to process the outer peripheral edge of the brittle plate.

* * * * *